US009050514B1

(12) United States Patent
Mirza

(10) Patent No.: US 9,050,514 B1
(45) Date of Patent: Jun. 9, 2015

(54) MARTIAL ARTS TRAINING DUMMY

(71) Applicant: Abdullah Ayman Abd Alrasoul Mirza, Al Andalous (KW)

(72) Inventor: Abdullah Ayman Abd Alrasoul Mirza, Al Andalous (KW)

( * ) Notice: Subject to any disclaimer, the term of this patent is extended or adjusted under 35 U.S.C. 154(b) by 0 days.

(21) Appl. No.: 14/589,930

(22) Filed: Jan. 5, 2015

(51) Int. Cl.
*A63B 69/34* (2006.01)
*G09B 19/00* (2006.01)
*A63B 69/00* (2006.01)

(52) U.S. Cl.
CPC ..... *A63B 69/004* (2013.01)

(58) Field of Classification Search
CPC ..... A63B 69/004; A63B 69/34; A63B 2071/026; A63B 2071/0063
USPC ..... 482/83–90; 434/270, 274, 256; 446/375
See application file for complete search history.

(56) References Cited

U.S. PATENT DOCUMENTS

| | | | | | |
|---|---|---|---|---|---|
| 604,243 | A | * | 5/1898 | Verpillier | 446/375 |
| 2,129,421 | A | * | 9/1938 | Hales | 446/375 |
| 2,271,312 | A | * | 1/1942 | Shorter | 446/375 |
| 3,010,223 | A | * | 11/1961 | Alderson | 434/267 |
| 3,357,610 | A | * | 12/1967 | Quinby, Jr. | 223/68 |
| 3,557,471 | A | * | 1/1971 | Payne | 434/270 |
| 3,755,920 | A | * | 9/1973 | Smrcka | 434/274 |
| 3,804,406 | A | * | 4/1974 | Viscione | 482/4 |
| 3,895,451 | A | * | 7/1975 | Smrcka | 434/274 |
| 4,088,315 | A | * | 5/1978 | Schemmel | 482/4 |
| 4,387,892 | A | * | 6/1983 | Wen | 482/83 |
| 5,700,230 | A | | 12/1997 | Cardona | |
| 5,722,920 | A | * | 3/1998 | Bauer | 482/83 |
| 6,089,950 | A | * | 7/2000 | Lee et al. | 446/376 |
| 6,110,002 | A | * | 8/2000 | Langton | 446/375 |
| 6,139,328 | A | | 10/2000 | Picotte | |
| 6,155,960 | A | | 12/2000 | Roberts et al. | |
| 6,537,130 | B1 | * | 3/2003 | Lee et al. | 446/375 |
| 6,957,961 | B1 | * | 10/2005 | Owens et al. | 434/270 |
| 7,828,701 | B1 | * | 11/2010 | Chen | 482/83 |
| 8,439,809 | B2 | | 5/2013 | Machado et al. | |
| 2002/0193211 | A1 | * | 12/2002 | Kao | 482/83 |
| 2004/0053754 | A1 | * | 3/2004 | Tatton | 482/83 |
| 2011/0256990 | A1 | | 10/2011 | Machado et al. | |
| 2013/0137554 | A1 | | 5/2013 | Knight | |

OTHER PUBLICATIONS

Website, http://www.grapplingdummy.net/, Submission Master® grappling dummy, eight pages printed from the internet on Aug. 29, 2014.

* cited by examiner

*Primary Examiner* — Oren Ginsberg
*Assistant Examiner* — Andrew S Lo
(74) *Attorney, Agent, or Firm* — Richard C Litman

(57) ABSTRACT

The martial arts training dummy is an anthropomorphic mannequin formed of substantially solid resilient material, such as rubber or plastic, and having a specific gravity approximating that of the human body. The limbs at the shoulders, hips, and knees are pivotally attached to their adjacent components, the joints having sufficient friction to hold a set position after adjustment. The training dummy is devoid of external support and, while being incapable of standing erect, it may be positioned on hands and knees or on its back for practicing various ground moves and holds in various martial arts. The upper arms, thighs, and lower trunk are hollow and have springs installed therein. The springs have bending resistances approximately equal to the forces required to break bones of the corresponding areas of the human body. A limb suffering a simulated breakage will return to its original position without damage for continued practice.

3 Claims, 3 Drawing Sheets

MARTIAL ARTS TRAINING DUMMY

BACKGROUND OF THE INVENTION

1. Field of the Invention

The present invention relates to sports and games of physical strength and skill, and particularly to a martial arts training dummy having an anthropomorphic configuration capable of allowing the practitioner to simulate injury to the dummy without damaging the dummy.

2. Description of the Related Art

There are a number of different martial art forms, e.g., judo or jiu-jitsu, Greco-Roman and other forms of wrestling, and various other grappling forms of personal combat. Most of these martial art forms entail a one-on-one confrontation between two participants, and training or practice of these various forms involves two participants or partners who practice and train with one another. The object in most martial art forms is to injure or disable the opponent, but when working with another human as a training partner, one must exercise caution in order to avoid inflicting actual injury to the partner or other participant.

In martial art competitions, participants are separated or categorized according to their weight. Thus, it is desirable for a practitioner to work with a partner who not only has the required skills to provide a valuable workout for the practitioner, but who is also of the approximate same size and weight. It is also desirable during practice to repeat various moves or holds in order to develop "muscle memory" for the specific moves and holds. Accordingly, it will be seen that it can be quite difficult for a martial arts practitioner to locate a willing partner who is (a) skilled in the martial art, (b) of approximately the same size and weight as the practitioner, (c) is willing to allow himself to be subjected to repeated martial art moves and holds, and (d) is willing to take the risk that he might be injured during the training session.

Thus, a martial arts training dummy solving the aforementioned problems is desired.

SUMMARY OF THE INVENTION

The martial arts training dummy comprises an anthropomorphic body formed of a substantially solid resilient material, such as rubber or plastic. The specific gravity of the material is selected to produce a body having a specific gravity that is reasonably close to that of water, as the human body also has a specific gravity nearly the same as water. The training dummy may be produced in a wide range of sizes and weights to meet the needs of martial arts practitioners of different sizes and weights.

The martial arts training dummy is free standing, in that it has no additional external support structure. While the training dummy is incapable of being balanced in a standing posture balanced upon its feet, it can be manipulated to support itself on its hands and knees or manipulated to lie on its back or side to allow its limbs to be positioned as desired for other training moves or holds. The joints at the upper arms and shoulders, thighs and hips, and knees include pins to allow the associated limbs or extremities to be positioned as desired to practice a given move or hold. Each of the pivoting joints has sufficient friction to hold the position of the limb as set, but the limb may be pivoted to a different position by exerting sufficient force to overcome the friction of the joint.

Various portions of the martial arts training dummy are hollow and include relatively stiff springs, e.g., coil springs, therein. These springs are preferably installed in the upper arms in place of the humerus or upper arm bone, the thighs in place of the femur or upper leg bone, and in the lower torso or trunk area. These springs are selected to have bending resistances approximately equal to the force required to break the bone or bones of those portions of the body where the springs are located, and are selected to have appropriate bending resistances for the size and weight of the training dummy in which they are installed.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
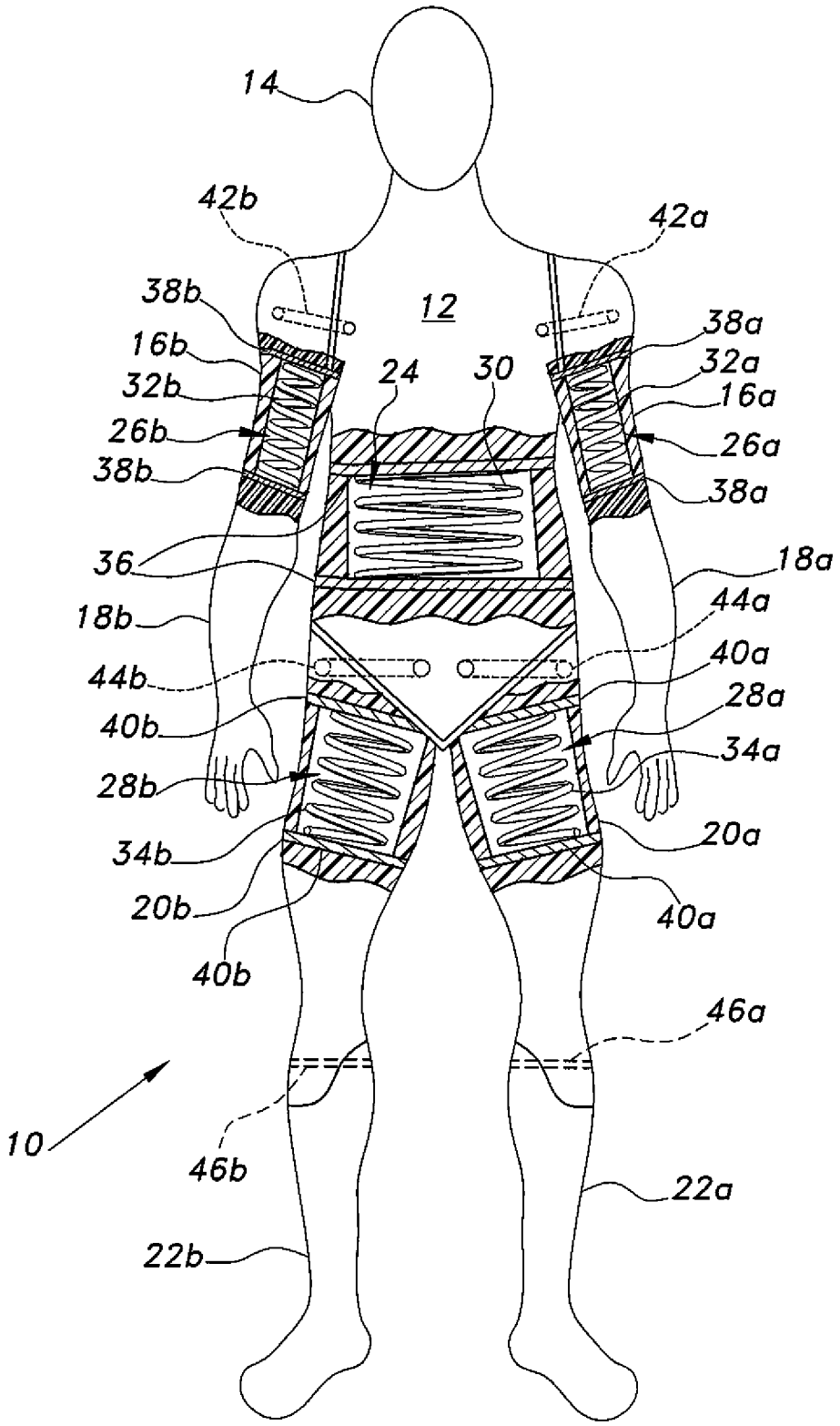
FIG. 1 is a front elevation view of a martial arts training dummy according to the present invention, shown with portions broken away and partially in section to show details thereof.

The martial arts training dummy provides a realistic and relatively economical training aid for practicing and training in various martial arts without fear or concern for injury to a living human practice opponent. FIG. 1 of the drawings provides an elevation view in partial section of the martial arts training dummy 10. The training dummy 10 is an anthropomorphic mannequin having a structure comprising a trunk 12, a head 14, left and right upper arms 16*a* and 16*b*, left and right lower arms 18*a* and 18*b*, left and right upper legs or thighs 20*a* and 20*b*, and left and right lower legs 22*a* and 22*b*. The general structure of the training dummy 10 is formed of substantially solid resilient rubber or plastic material, which has a specific gravity of substantially 1.0, i.e., that of water, which closely approximates the specific gravity of the normal human body.

Figure 3:
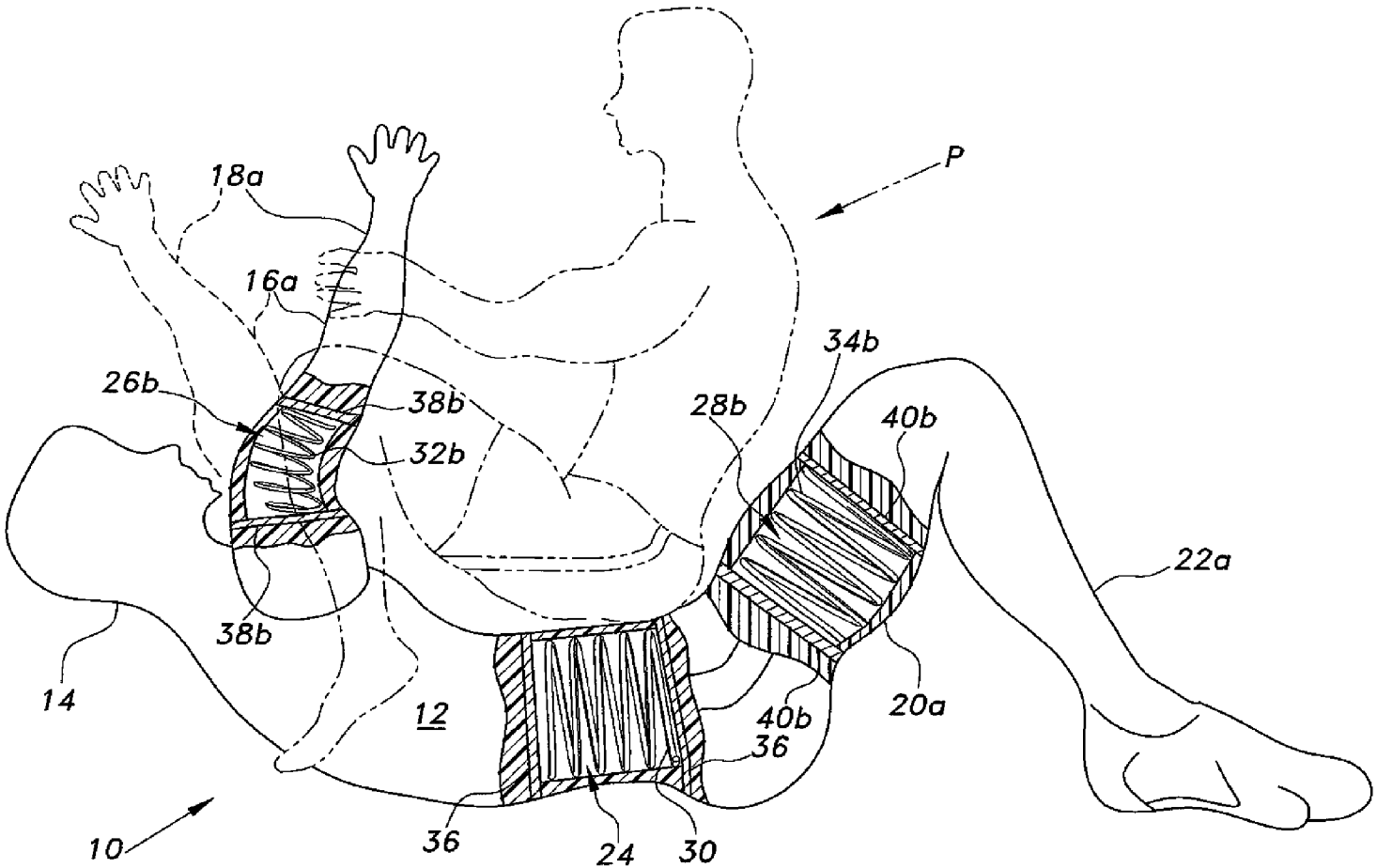
FIG. 3 is an environmental side elevation view of the martial arts training dummy according to the present invention, shown with portions broken away and partially in section to show details thereof, showing a second position of use and simulated injury to the dummy.

Each of the upper limbs 16*a*, 16*b*, 20*a*, and 20*b* and the trunk 12 has spring cavities therein, the lower portion of the trunk 12 having a spring cavity 24 therein, the upper arms 16*a*, 16*b* having spring cavities 26*a* and 26*b*, and the upper legs or thighs 20*a*, 20*b* having spring cavities 28*a* and 28*b* therein. Each of these spring cavities includes a reasonably stiff spring therein, e.g., a heavy coil spring, as shown in FIGS. 1 and 3. While the spring cavities tend to reduce the collective specific gravity of the training dummy 10, the mass of the heavy springs within those cavities tends to counteract the loss of mass from the cavities due to the cavities being hollow, thus resulting in an overall specific gravity closely approximating that of the human body. The trunk spring cavity 24 contains a heavy trunk spring 30, the left and right upper arm cavities 26*a* and 26*b* contain left and right upper arm springs 32*a* and 32*b*, and the left and right upper leg cavities 28*a* and 28*b* contain left and right upper leg or thigh springs 34*a* and 34*b*. Each of these springs is substantially concentric with its corresponding trunk or limb shell, and is selected to provide substantial bending resistance on the order of the force required to break a bone situated in a corresponding location in the human body.

Each of the springs 30 through 34*b* is captured between a pair of metal retaining plates situated at opposite ends of their respective spring cavities. The trunk spring 30 is captured between first and second trunk spring retaining plates 36, the left and right upper arm springs 32*a* and 32*b* are captured between first and second upper arm spring plates 38*a* and 38*b*, and the left and right upper leg springs 34*a* and 34*b* are captured between first and second upper leg spring retaining plates 40*a* and 40*b*. These spring retaining plates 36 through 40*b* serve as rigid seats for the opposite ends of their corresponding springs, anchoring the springs in place within their respective components of the training dummy 10.

The upper arms, upper legs, and lower legs are each attached to their adjacent components by corresponding pivot pins. The upper arms 16*a*, 16*b* are pivotally secured to the shoulder areas of the trunk 12 by respective upper arm pivot pins 42*a* and 42*b*, the upper legs or thighs 20*a* and 20*b* are pivotally secured to the base of the trunk 12 by respective upper leg or thigh pivot pins 44*a* and 44*b*, and the lower legs 22*a* and 22*b* are secured to the upper legs or thighs 20*a* and 20*b* by respective knee pivot pins 46*a* and 46*b*. Each of the joints defined by these pins 42*a* through 46*b* is relatively stiff, i.e., the joint has a reasonable amount of frictional resistance. This allows the limbs extending from these joints to be positioned as desired and to maintain that set position until forcibly moved by the practitioner using the training dummy 10. It will be noted that the upper arm pivot pins 42*a* and 42*b* and the upper leg or thigh pivot pins 44*a* and 44*b* are disposed at angles through the body of the training dummy 10, i.e., they extend at approximately a 45° angle from the outer rear through the dummy structure forward and inward to the front of the structure. This allows these joints to be positioned realistically, so that the corresponding limbs move upward and outward when they are pivoted from their straight positions, as shown in FIG. 1.

Figure 2:
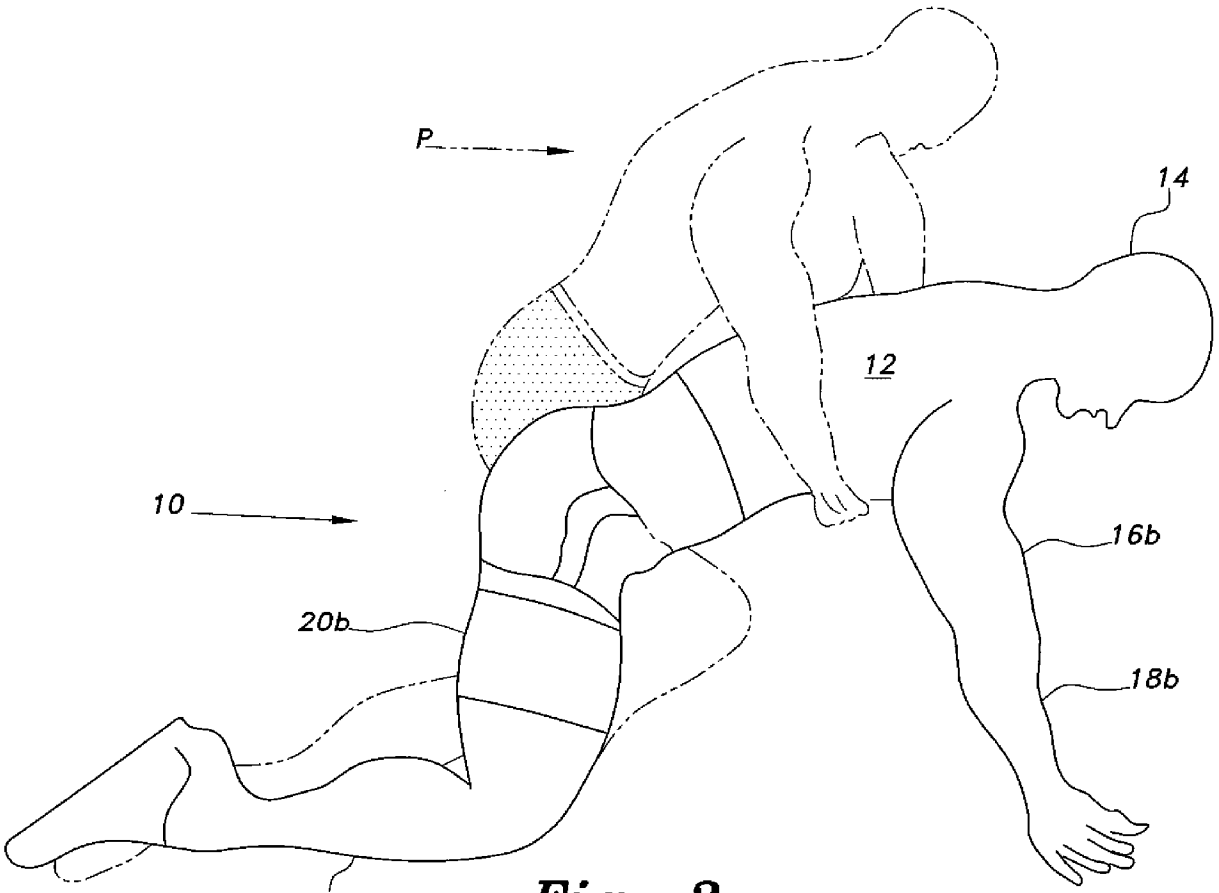
FIG. 2 is an environmental side elevation view of the martial arts training dummy according to the present invention, showing a first position of use.

FIG. 2 provides an illustration of a practitioner P using the training dummy 10 to practice a grappling martial arts hold, wherein the dummy 10 is set in a grounded position simulating a Greco-Roman wrestling starting position. The practitioner sets the various limbs 16*a*, 16*b*, 20*a*, 20*b*, 22*a*, and 22*b* as desired to set up the dummy 10 in the desired stance or position for practice. The training dummy 10 remains in this set position due to the friction of the various joints. When this has been accomplished, the practitioner may use the dummy 10 to practice various holds and moves from various positions in accordance with the initially set position or stance of the dummy. The various joints of the dummy 10 tend to remain in their initially set positions unless forcibly moved by the practitioner during the practice or training session.

In FIG. 3 the practitioner P is shown in a superior position atop the training dummy 10, the dummy 10 being positioned on its back. The practitioner P has positioned his left knee against the right upper arm 16*a* of the dummy 10, the normally straight left upper arm and lower arm 16*a* and 18*a* being shown in broken lines. This position enables the practitioner P to grip the left arm of the training dummy 10 and draw it toward the practitioner P, against the knee of the practitioner. When sufficient force is applied, the right upper arm spring 32*b* will be bent or deflected, as shown in solid lines in FIG. 3, the right upper arm 16*a* bending or deflecting accordingly to simulate the breakage of the right humerus or upper arm bone in a human opponent.

Thus, the training dummy 10 allows the practitioner to practice holds and moves that would be injurious to a living opponent in practice or training, whereas the practitioner P would be unable to exert maximum force and pressure against a living opponent in practice or training. This provides considerably more realistic training and practice for the practitioner. The limb(s) of the martial arts training dummy 10 returns to its normal straight and unbroken condition when pressure is released, thereby allowing the practitioner to continue to practice the same or other moves and holds while applying the maximum force achievable to gain the maximum benefit available in a practice or training session.

It will be seen that the training dummy 10 may be constructed to any practicable size or scale to allow practitioners of any size and weight to use a practice dummy corresponding to their own size and weight. The density or specific gravity of the resilient plastic or rubber material of which the practice dummy is constructed will automatically result in a dummy weight corresponding closely to the weight of the practitioner when a dummy of corresponding height to the practitioner is selected. Similarly, the various springs within the dummy may be selected to correspond not only with the approximate strength of the bone in a given part of the human anatomy, but may also be selected to correspond with the different bone strengths found in humans of different sizes, ages, and sexes. Thus, a practitioner will always be able to practice realistically using a martial arts training dummy of corresponding size and weight.

It is to be understood that the present invention is not limited to the embodiments described above, but encompasses any and all embodiments within the scope of the following claims.

I claim:

1. A martial arts training dummy, consisting of:

an anthropomorphic mannequin having a trunk, left and right upper and lower arms, left and right upper and lower legs, and a head, wherein the mannequin is formed of a solid resilient material having a specific gravity of 1.0, the material having spring cavities defined solely in the upper arms, the upper legs, and the trunk;

each of the spring cavities having first and second spaced apart spring retaining plates disposed in each of the upper arms, the upper legs, and the trunk;

left and right upper arm springs being captured between the corresponding first and second spring retaining plates disposed in the left and right upper arms, respectively, substantially concentric therewith;

left and right upper leg springs being captured between the corresponding first and second spring retaining plates disposed in the left and right upper legs, respectively, substantially concentric therewith;

a trunk spring being captured between the corresponding first and second spring retaining plates disposed in the lower trunk, substantially concentric therewith, each of the springs having a bending resistance approximating the force required to break a bone situated in a corresponding location of the human body; and a pivotal friction joint disposed between each of the upper arms and the trunk, each of the upper legs and the trunk, and each of the upper legs and the corresponding lower legs.

2. The martial arts training dummy according to claim 1, wherein each of the springs is a coil spring.

3. A martial arts training dummy, comprising:

an anthropomorphic mannequin having a trunk, left and right upper and lower arms, left and right upper and lower legs, and a head, wherein the mannequin is formed of a solid resilient material having a specific gravity of 1.0, the material having spring cavities defined solely in the upper arms, the upper legs, and the trunk;

each of the spring cavities having first and second spaced apart spring retaining plates disposed in each of the upper arms, the upper legs, and the trunk;

left and right upper arm springs being captured between the corresponding first and second spring retaining plates disposed in the left and right upper arms, respectively, substantially concentric therewith;

left and right upper leg springs being captured between the corresponding first and second spring retaining plates disposed in the left and right upper legs, respectively, substantially concentric therewith;

a trunk spring being captured between the corresponding first and second spring retaining plates disposed in the lower trunk, substantially concentric therewith, each of the springs having a bending resistance approximating the force required to break a bone situated in a corresponding location of the human body; and a pivotal friction joint disposed between each of the upper arms and the trunk, each of the upper legs and the trunk, and each of the upper legs and the corresponding lower legs.

* * * * *